US005206508A

United States Patent [19]

Alderdice et al.

[11] Patent Number: 5,206,508

[45] Date of Patent: Apr. 27, 1993

[54] TANDEM MASS SPECTROMETRY SYSTEMS BASED ON TIME-OF-FLIGHT ANALYZER

[75] Inventors: David S. Alderdice; Peter J. Derrick; Daniel J. Jardine, all of Kensington, Australia

[73] Assignee: Unisearch Limited, Kensington, Australia

[21] Appl. No.: 776,789

[22] Filed: Oct. 18, 1991

[30] Foreign Application Priority Data

Oct. 18, 1990 [AU] Australia ..... PK2854

[51] Int. Cl.[5] ..... H01J 49/26

[52] U.S. Cl. ..... 250/287; 250/281; 250/282

[58] Field of Search ..... 250/287, 281, 282

[56] References Cited

U.S. PATENT DOCUMENTS

| | | | |
|---|---|---|---|
| 4,234,791 | 11/1980 | Enke et al. | 250/281 |
| 4,894,536 | 1/1990 | Conzemius | 250/287 |
| 4,988,869 | 1/1991 | Aberth | 250/281 |
| 5,032,722 | 7/1991 | Boesl et al. | 250/281 |
| 5,073,713 | 12/1991 | Smith et al. | 250/287 |

FOREIGN PATENT DOCUMENTS 2129607 12/1985 United Kingdom .

OTHER PUBLICATIONS

Tandem Quadrupole/Time-of-Flight Instrument for Mass Spectrometry/Mass Spectrometry, Glish & Goeringer, Anal. Chem 1984, 56, 2291-2295.

"Photodissociation of size-selected, . . . " C. Brechignac, et al. Mar. 1, 1988, pp. 3022-3027.

"A Tandem Time-of-Flight Mass Spectrometer, . . . ", R. G. Cooks, et al., Feb. 2, 1987, pp. 49-61.

*Primary Examiner*—Jack I. Berman
*Assistant Examiner*—Kiet T. Nguyen
*Attorney, Agent, or Firm*—Jacobson, Price, Holman & Stern

[57] ABSTRACT

A tandem mass spectrometry system, capable of obtaining tandem mass spectra for each parent ion without separation of parent ions of differing mass from each other, comprising an ion source, (1) a particle detector (6), two separated time-of-flight devices (3, 5) between the source and the detector, a control ion-excitation device (4) between the time-of-flight devices, and means measuring a time-of-flight for particles reaching the detector (6), all of which lie on a common ion path, and wherein ion optics maintain ion flight from the source within the ion path and a computer control system controls the excitation device (4) and the optics.

16 Claims, 4 Drawing Sheets

TANDEM MASS SPECTROMETRY SYSTEMS BASED ON TIME-OF-FLIGHT ANALYZER

BACKGROUND OF THE INVENTION

This invention relates to tandem mass spectrometry systems based on principles of analysis by time-of-flight (TOF). The object is to identify what molecules are present in a sample. The mass of a molecule may be readily measured by providing it with an amount of kinetic energy and measuring its velocity by time-of-flight techniques. However a number of different molecules may have the same mass and these can be distinguished from one another by dissociation and analysis of the masses of the daughters that are produced. In recent years there has arisen the need to analyse by tandem mass spectrometry, with the highest sensitivities, complex biological and other molecules and complex mixtures of molecules.

PRIOR ART

Known tandem mass spectrometry systems necessitate selection of ions of a particular mass prior to excitation of that ion to obtain a tandem mass spectrum. A tandem TOF described by Cooks et al (Int. J. Mass Spectrom Ion Proc., 77, 49–61 (1987)) employed ion selection prior to surface-induced dissociation and collection of fragment ions along a direction perpendicular to the direction of travel of the selected parent ion. The method suffered from poor resolution and sensitivity, being characteristics of the surface-induced excitation and perpendicular collection. Brechignac et al (J. Chem Phys., 88, 3022–3027 (1988)) described a tandem TOF employing photodissociation of a selected mass ion, with a linear low-resolution TOF as the second analyser.

Typical of the prior art is the use of a machine which physically selects particles of a common mass and discards particles of any different mass. Conveniently this is done by ionising a portion of the available sample and firing the produced ions down an ion path through a device such as a magnetic bending or quadrupole device. After exiting such selection device all ions on a particular path will have a common mass, and a common kinetic energy, and the mass can then be determined by measuring the time-of-flight over a set distance. A second experiment is then run, using a further portion of the sample, subjecting the parent ions to dissociation and applying an electric field across the ion path so as to modify the kinetic energy of the various daughters according to their electrical charge. The time-offlight analysis of these daughters compared with the parent then allows identification of the constituents of the parent ion. Where a complete analysis of the sample is required, then the same sets of two experiments must be conducted for all masses present in the sample.

Where complete analysis of a sample is required, the overall process therefore consumes significant time and sample quantity. In cases where only limited sample quantity is available, then each experiment might need to use less than the ideal quantity which will degrade the sensitivity and accuracy of the results.

Where large molecules such as complex biological specimens are to be analysed, large electrical potentials are required in the initial cell which is used to select ions of a particular common mass.

OBJECT OF THE INVENTION

It is the object of the present invention to provide a tandem mass spectrometry system which is capable of simultaneously obtaining tandem mass spectra for each ion present in the primary mass spectrum without separating those ions from each other. This system would in addition provide the capability to select a particular ion prior to excitation, should this be either desirable or necessary for a given application.

According to one broad form, the invention can be said to provide a tandem mass spectrometry system comprising an ion source, a particle detector, two separated time-of-flight devices between the source and detector, control ion-excitation device between the time-of-flight devices, and means measuring the time-of-flight from the source to the detector, all of which lie on a common ion path, and wherein ion optics maintain ion flight from the source within the ion path and a computer control system controls the excitation device and the optics.

The means of producing ions may be electron impact, field ionization, field desorption, chemical ionization, electrospray, ion or atom bombardment (fast atom bombardment), laser desorption or resonance-enhanced multiphoton ionization. Excitation of ions may be through collision with a gas or through laser-induced photodissociation.

In another form the invention can be said to comprise a method of tandem mass spectrometry comprising forming an ion flow along a path from an ion source to a detector, directing the path through a first time-of-flight device, thence through a ion excitation device, thence through a second time-of-flight device, thence detecting ions at the detector including measurement of the time-of-flight of the ions and selectively applying a controlled electric field in the region of the excitation device.

Preferably the controlled electric field applied in the region of the excitation device is of a magnitude such that the detected mass spectrum includes distinguishable peaks corresponding to individual daughters grouped proximate a point in the spectrum corresponding to the peak of the associated parent obtained with a zero electric field.

Embodiment of tandem mass spectrometry systems, henceforth referred to as TOF—TOF's, in accordance with the invention will now be described, by way of example only, with reference to the accompanying drawings in which.

Figure 1:
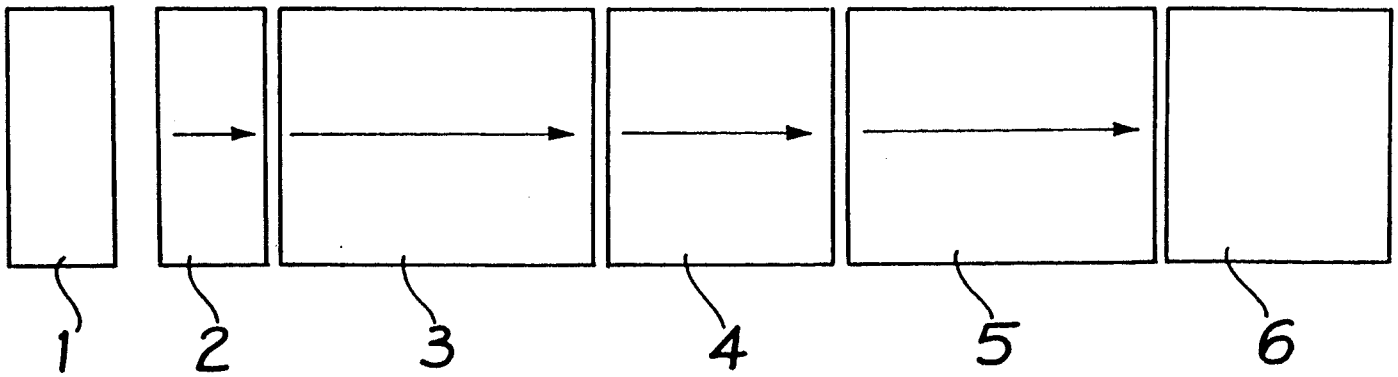
FIG. 1 is a diagrammatic representation of a TOF—TOF employing linear flight paths.
Figure 3:
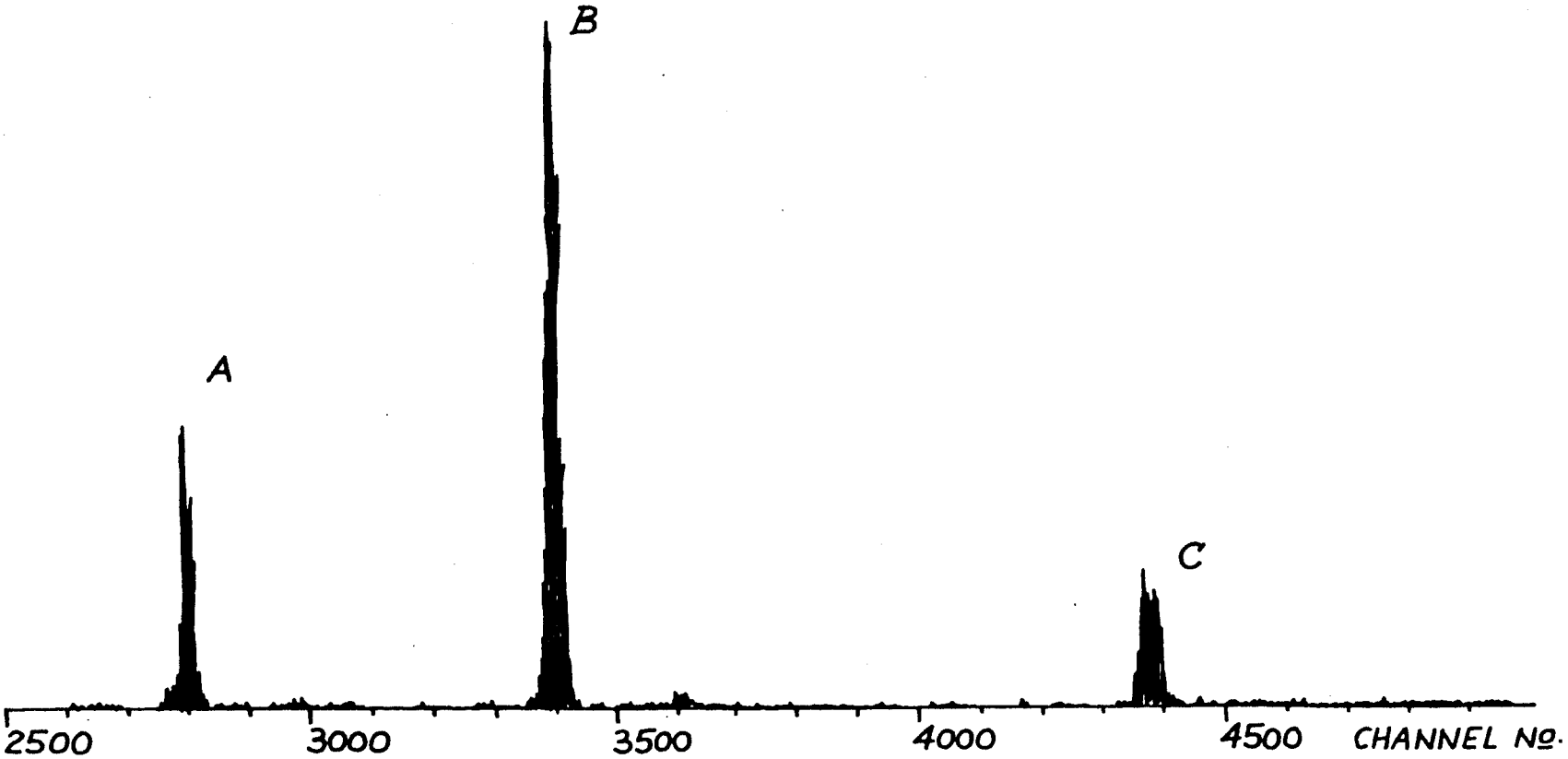
FIG. 3 is a representation of a spectrum measured using the invention.

Referring firstly to FIG. 1, this TOF—TOF comprises an ion source 1, transfer optics 2, a time-of-flight mass spectrometer 3, an excitation region with suitable transfer optics 4, a second time-of-flight mass spectrometer 5 and a particle detector 6. The ion source may be pulsed, so that ions are formed only within defined time intervals. Alternatively, ions may be formed continuously, but only allowed to enter TOF-MS 3 within defined time intervals. The latter situation may be realised by "bunching" the ions or by deflecting ions. A primary mass spectrum may be obtained by transferring the ions from source to detector without excitation in region 4, and measuring flight-times, along a convenient section of the path such as from the source 1 to the detector 6, for the different ions. Typically the mass spectrum is obtained by counting the number of ions striking the detector in each time interval, as shown in FIG. 3. Tandem mass spectra may be obtained in a number of different ways. Deflection plates in the transfer optics of region 4 may be used to select a particular ion prior to excitation. Fragmentation is induced by excitation, and the tandem mass spectrum for that selected ion measured using TOF-MS 5. The tandem mass spectrum exhibits both ions and neutral species resulting from the excitation process. The capability for observing neutral species is one aspect that distinguishes this example of TOF—TOF from most other tandem mass spectrometers.

A tandem mass spectrum of a particular ion may also be measured without selection prior to excitation, but with excitation of only the chosen ion. This may be achieved by using, for example, a laser pulse for excitation, in such a way that only the chosen ion is in the excitation region at the moment of excitation.

Furthermore, tandem mass spectra of all ions in the primary mass spectrum (i.e. in an original sample) may be obtained simultaneously by allowing all ions to enter the excitation region and exciting all ions. In the case of a wholly linear TOF—TOF as depicted in FIG. 1, the excitation region 4 is maintained at an electric potential different from that of the TOF-MS's 3 and 5 when measuring tandem mass spectra. If the TOF-MS's are at ground potential and the excitation region is at a positive potential, positively charged fragment ions from a positively charged parent ion have flight times through TOF-MS 5 shorter than that of the parent ion as the charge is similar but the mass less. Neutral species have a longer flight time than the parent ion, under these conditions, as the positive field does not accelerate the neutral daughter. If the TOF-MS's are at ground potential and the excitation region is at a negative potential, positively charged fragment ions from a positively charged parent ion have flight times through TOF-MS 5 longer than that of the parent ion. Neutral species have a shorter flight time than the parent ion, under these conditions. The tandem mass spectrum obtained in the case where all ions in the primary spectrum are excited contains all parent ions, all fragment ions from all parent ions and all neutral species from all parent ions. The fragments from each parent ion are identified through consideration of the shifts in the flight times, as the potential of the excitation region is varied. These shifts are preferably kept much smaller than the time-of-flight spread of the parents so as not to confuse which peaks are associated with each other. For instance the potential might be reversed. The mass of any fragment ion may be calculated, given its flight-time through TOF-MS 5 and the potential on the excitation region. TOF—TOF's may be fully computer controlled and mass assignment may be performed automatically by the computer.

Figure 2:
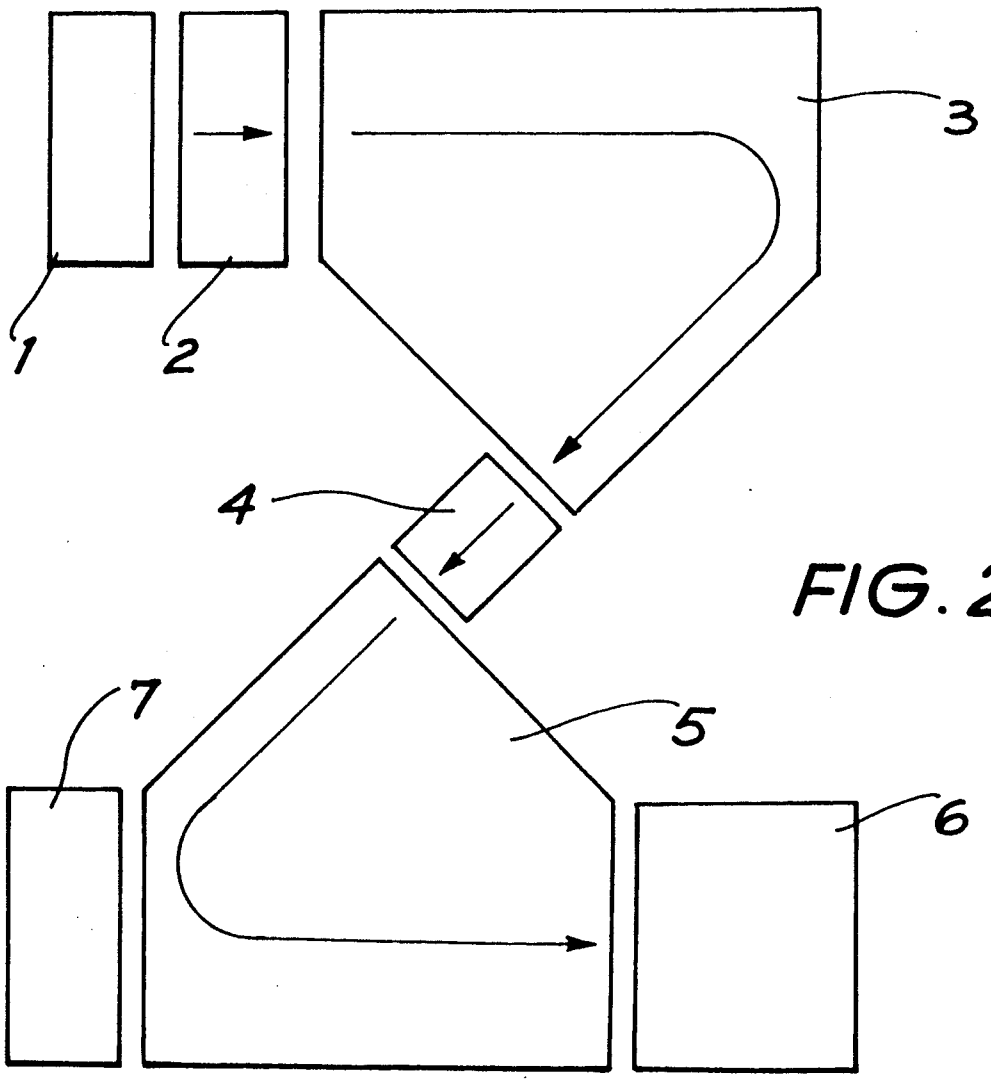
FIG. 2 is a diagrammatic representation of a TOF—TOF employing reflecting electrostatic mirrors.

A TOF—TOF may consist of a linear TOF-MS combined with a reflecting electrostatic mirror TOF-MS. The linear TOF-MS may precede or follow the electrostatic mirror TOF-MS. A TOF—TOF comprised of two reflecting electrostatic mirrors (FIG. 2) may be used in the same ways as the wholly linear TOF—TOF. With reflecting electrostatic mirrors, it may or may not be necessary to adjust the potential of the excitation region depending upon the iron optical characteristics of the mirrors. An electrostatic mirror may be of a type described by Manyrin et al (Sov. Phys. JETP 37, 45–48 (1973)) providing a degree of energy compensation and little spatial defocussing or a type described by Hamilton et al (Rev, Sci Instrum., 61, 3104–3106 (1990)) providing full energy compensation of an ion related to its mass-to-charge ratio even if ions of different masses have identical velocity. A detector 7 provides the capability for detecting neutral species.

The design of the transfer optics 2 and 4 will take account of the need to prevent excessive temporal pulse spreading, thereby maintaining high resolution in the TOF-MS's 3 and 5.

TOF—TOF may be applied to either positive or negative ions. TOF—TOF provides an infinite mass range. TOF—TOF provides parallel collection of ions not only for the primary mass spectrum, but also for all tandem mass spectra simultaneously. TOF—TOF provides capabilities which cannot be achieved using magnetic sector instruments and arrays or using quadrupoles. TOF—TOF will find particular application in the analyses of large molecules, for example in biotechnology, biochemistry, biology, medicine, polymer science and materials science. TOF—TOF will find particular application in the analyses of mixtures, for example in environmental studies. TOF—TOF will provide sensitivity greater than that achievable by other tandem mass spectrometry systems such as 4-sector and arrays or triple quadrupoles especially where a limited amount of sample is available.

The following description of a particular case will further exemplify the invention. A simple model compound CsI was bombarded with neutral xenon atoms at 5.3 keV energy. The TOF—TOF device consisted of linear TOF analysers 3 and 5, a collision cell to which can be applied negative or positive potentials forming the excitation region 4, and a microchannel plate acting as the particle detector 6.

Figure 4:
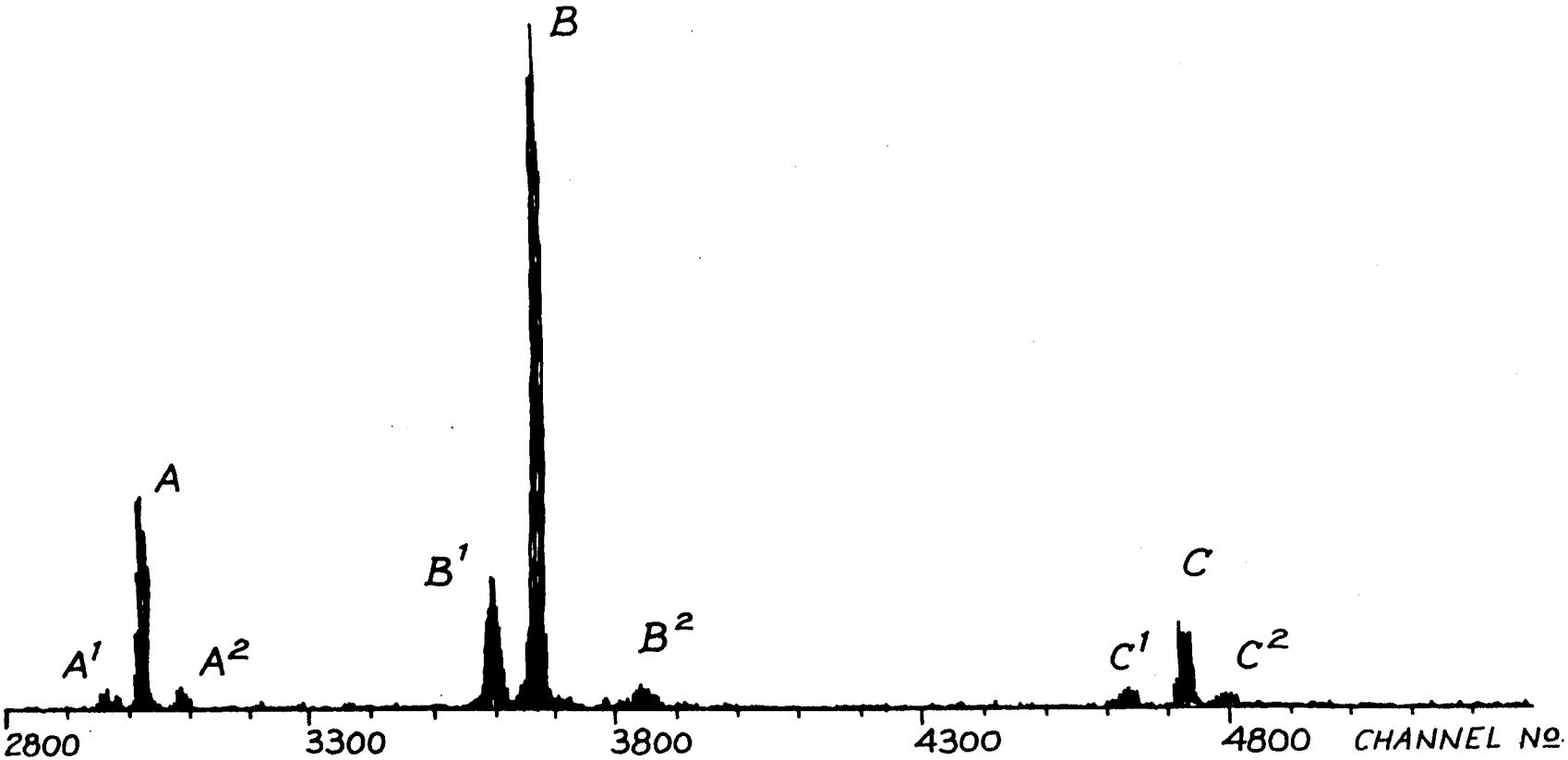
FIG. 4 is a representation of another spectrum measured using the invention with a collision gas present in the excitation region and a potential applied to the collision cell.

FIG. 3 shows the time-of-flight spectrum measured using the detector 6 at the end of the second TOF-MS5 when there is no collision gas present in, or potential applied to, the excitation region 4. The channel numbers on the x-axis are related to flight-times, which define the mass-to-charge ratios m/z of the ions. Larger channel numbers relate to longer times and higher m/z. The peaks relate to the number of particles detected during the time period associated with each channel number. Three strong peaks are observed, assigned to $Cs_2^+$, labelled A, $Cs_2I^+$, labelled B, and $Cs_3I_2^+$, labelled C. FIG. 4 shows another spectrum obtained by the detector 6 at the end of the second TOF-MS 5. This spectrum was obtained with argon present in the collision cell 4 at a pressure sufficient to reduce ion transmission by 50%. Also, the collision cell 4 potential was floated at −450 V. The strong peaks A, B and C are now each accompanied by preceding and proceeding sub-peaks $X^1$, $X^2$ (X representing the indicia A, B and C). The preceding small peaks $X^1$ indicating the various neutrals which result from ion collisions, the proceeding small peaks $X^2$ representing fragment ions from the same collision induced decomposition, $A^2$-$Cs^+$, $B^2$-$Cs^+$ and $C^2$-$Cs_2I^+$. Both the parent ions and fragment ions, being positively charged, were decelerated on leaving the collision cell 4, due to the negative potential applied to the collision cell 4, and entering the second TOF-MS 5, the speed of the neutrals being unaffected. The fragment ions are slowed more than are the parent ions, due to their lower mass.

It is clear that it is unnecessary, in this machine, to separate the three parent ions prior to collision induced decomposition and thus necessary data can be collected from a much smaller quantity of sample than would be required in many other types of devices.

Where the parent ion is unknown, a second machine run is conducted with a different potential applied to the collision cell 4, for example by floating the collision cell 4 at a potential of +450 V, resulting in the preceding and proceeding small peaks being reversed. By mathematical analysis of the measured spectrum, parent/fragment ion relationships can be identified and fragment ion masses determined.

It will be recognised by persons skilled in the art that numerous variations and modifications may be made to the invention as described above without departing from the spirit or scope of the invention as broadly described.

We claim:

1. A tandem mass spectrometry system, capable of obtaining tandem mass spectra for each parent ion without separation of parent ions of differing mass from each other, comprising an ion source, a particle detector, two separated time-of-flight devices between the source and the detector, a control ion-excitation device between the time-of-flight devices, and means measuring a time-of-flight for particles reaching the detector, all of which lie on a common ion path, and wherein ion optics maintain ion flight from the source within the ion path and a computer control system controls the excitation device and the optics such that the parent ion of differing mass need not be separated from one another in order to obtain tandem mass spectra for each parent ion.

2. A system of claim 1, wherein the ion-excitation device is a gas filled collision cell.

3. A system of claim 1, wherein the ion-excitation device is a laser-induced photodissociation device.

4. A system as in claim 1, wherein the ion source is an electron impact device.

5. A system as in claim 1, wherein the ion source is a field ionization device.

6. A system as in claim 1, wherein the ion source is a field desorption device.

7. A system as in claim 1, wherein the ion source is a chemical ionization device.

8. A system as in claim 1, wherein the ion source is a electrospray or ion spray device.

9. A system as in claim 1, wherein the ion source is a particle bombardment device.

10. A system as in claim 1, wherein the ion source is a laser desorption device.

11. A system as in claim 1, wherein the ion source is a resonance-enhanced multiphoton ionization device.

12. A system as in claim 1, wherein at least one of the time-of-flight devices comprises an electrostatic mirror type time-of-flight device.

13. A method of conducting tandem mass spectrometry comprising ionising a sample and firing the ions, without selecting ions of particular mass, along an ion path passing through a first time-of-flight device, thence through a control ion-excitation device to which a controlled electric potential is selectively applied such that ions of a particular mass need not be selected, thence through a second time-of-flight device so as to reach a particle detector where the time-of-flight of each detected particle is measured and simultaneously obtaining a tandem mass spectrum for each parent ion.

14. A method of claim 13 wherein the experiment is run a plurality of times, each time a different value electric potential is applied to the ion-excitation cell.

15. A method of claim 14 wherein the selected controlled electric potentials are such as to spread apart time-of-flight measurements of corresponding parent and daughter species sufficiently to distinguish therebetween without overlapping tandem mass spectra of adjacent parent ions.

16. A method of claim 13 wherein the ion-excitation cell is a gas filled collision cell.

* * * * *